US006976875B2

(12) United States Patent
Nishide

(10) Patent No.: US 6,976,875 B2
(45) Date of Patent: Dec. 20, 2005

(54) DIVIDED CONNECTOR AND METHOD OF DISENGAGING AN AUXILIARY CONNECTOR HOUSING THEREFROM

(75) Inventor: Satoru Nishide, Yokkaichi (JP)

(73) Assignee: Sumitomo Wiring Systems, Ltd, (JP)

( * ) Notice: Subject to any disclaimer, the term of this patent is extended or adjusted under 35 U.S.C. 154(b) by 0 days.

(21) Appl. No.: 10/977,787

(22) Filed: Oct. 29, 2004

(65) Prior Publication Data

US 2005/0095910 A1 May 5, 2005

(30) Foreign Application Priority Data

Oct. 29, 2003 (JP) ..... 2003-368916
Oct. 31, 2003 (JP) ..... 2003-371665
Nov. 4, 2003 (JP) ..... 2003-374339

(51) Int. Cl.[7] ..... H01R 13/40
(52) U.S. Cl. ..... 439/598; 439/686
(58) Field of Search ..... 439/353, 598, 439/903, 686, 695

(56) References Cited

U.S. PATENT DOCUMENTS 4,682,839 A * 7/1987 Bryce ..... 439/598
5,328,288 A 7/1994 Masuda
6,533,602 B2 * 3/2003 Nankou ..... 439/352
2002/0173198 A1 11/2002 Plate

FOREIGN PATENT DOCUMENTS

JP 2000-331738 11/2000

* cited by examiner

*Primary Examiner*—Tho D. Ta
(74) *Attorney, Agent, or Firm*—Gerald E. Hespos; Anthony J. Casella

(57) ABSTRACT

Grooves (39) are formed in locking projections (38) provided on side surfaces of an auxiliary connector (30), and disengaging projections (27) which can enter the grooves (39) project from locking surfaces (26A) of locking pieces (26) provided on inner side walls of an accommodating portion (12). The locking piece (26) can be disengaged form the corresponding locking projection (38) by pressing an introducing surface (27A) of the disengaging projection (27) in the groove (39) by means of a jig (J) to resiliently deform the locking piece (26). Since the locking pieces (26) can be made smaller than prior art ones, deformation spaces therefor can also be made smaller, which enables the miniaturization of a housing main body (11) or the miniaturization of male and female connectors (50, 10).

13 Claims, 16 Drawing Sheets

DIVIDED CONNECTOR AND METHOD OF DISENGAGING AN AUXILIARY CONNECTOR HOUSING THEREFROM

BACKGROUND OF THE INVENTION

1. Field of the Invention

The invention relates to a divided connector and to a method of disengaging or disassembling an auxiliary connector housing therefrom.

2. Description of the Related Art

Japanese Unexamined Patent Publication No. 2000-331738 and FIG. 16 herein show a divided connector. With reference to FIG. 16, the divided connector has a housing main body 1 and an auxiliary connector housing 2 is accommodated in an accommodating portion 3 of the housing main body 1. Two resiliently deformable locking pieces 4 are cantilevered from the inner sidewalls of the accommodating portion 3. Locking surfaces 4A are formed at the leading ends of the locking pieces 4 and locking projections 5 are provided on side surfaces of the auxiliary connector housing 2. The auxiliary connector housing 2 is inserted into the accommodating portion 3 from behind (from above in FIG. 16) and causes the locking pieces 4 to deform outward. The locking pieces 4 return resiliently towards an undeflected position when the auxiliary connector housing 2 reaches a proper position. As a result, the locking surfaces 4A at the leading ends of the locking pieces 4 engage the rear surfaces of locking projections 5 to lock the auxiliary connector housing 2 in the accommodating portion 3. A disengaging projection 4B is formed at the leading end of each locking piece 4 and is located at an outer side of the locking surface 4A. Additionally, the disengaging projection 4B projects forward beyond the leading end of the locking projection 5. A jig can be inserted from the front to press the disengaging projection 4B outward when the mounted auxiliary connector housing 2 needs to be detached for maintenance. As a result, the locking piece 4 disengages from the locking projection 5.

The locking pieces 4 are deformed outward during the insertion of the auxiliary connector housing 2. Thus, the housing main body 1 has deformation spaces S for permitting the deformation of the locking pieces 4. The disengaging projections 4B of the locking pieces 4 must have a sufficient length to project more forward than the front ends of the locking projections 5. Therefore, the length of the locking pieces 4 is longer by the length of the locking projections 5, and the deformation spaces S for the locking pieces 4 must be correspondingly larger. This hinders the miniaturization of the housing main body 1 and the miniaturization of the entire connector.

The invention was developed in view of the above problem and an object thereof is to provide a divided connector that can be miniaturized while enabling locking pieces to be disengaged by a jig.

SUMMARY OF THE INVENTION

The invention relates to a divided connector with a housing main body that has at least one accommodating portion. At least one auxiliary housing is insertable from behind into the accommodating portion. At least one resiliently deformable lock is cantilevered from an inner sidewall of the accommodating portion and has a locking surface at the leading end thereof. A locking projection is provided on a side surface of the auxiliary housing. The locking surface of the resiliently deformable lock engages the rear surface of the locking projection to prevent the auxiliary housing from coming out. At least one groove is formed in the locking projection and a jig can be inserted into the groove from the front. A disengaging projection projects from the locking surface of the locking piece and can be located in the groove when the locking surface and the locking projection engage one another. The locking surface can be disengaged from the locking projection by using the jig to press the disengaging projection in the groove for resiliently deforming the lock.

The disengaging projection need not project more forward than the locking projection. Thus, the lock can be shorter as compared to the prior art. Further, it is unnecessary to displace the disengaging projection from the locking surface along the thickness direction. Accordingly the leading end of the lock can be thinner and a deformation space for the lock can be made smaller. As a result, the housing main body and the entire connector can be miniaturized. Taking material out of the lock to form a recess for the jig would reduce the strength of the lock. However, the disengaging projection projects from the locking surface, and thus the lock is not weakened.

The disengaging projection may have an introducing surface that is inclined to introduce the leading end of the jig into a clearance between the disengaging projection and the side surface of the auxiliary connector housing. Additionally, the lock is guided by the introducing surface and is deformed in a disengaging direction from the locking projection by bringing the leading end of the jig into contact with the introducing surface to push the disengaging projection backward. Thus, unlocking can be effected merely by pushing the jig, and operational efficiency is better.

A clearance between the disengaging projection and a wall surface of the groove along the widthwise direction of the groove preferably exceeds a clearance between the auxiliary connector housing and a wall surface of the accommodating portion along the widthwise direction of the groove. Thus, the disengaging projection will not interfere with the wall surface of the groove and will not hinder movement of the lock when the locking projection engages the lock. Therefore, secure locking can be effected.

A clearance preferably is defined along forward and backward directions between the locking surface of the lock and the locking projections.

A rear surface of the locking projection preferably is undercut to define a slope that bulges out and back towards the leading end thereof.

The housing main body preferably has at least one cavity for receiving at least one main-body terminal fitting.

A retainer preferably is mounted at a restricting position in the housing main body to lock the main-body terminal fittings in the housing main body.

The auxiliary connector housing preferably is configured to avoid interference with the retainer and to permit the retainer to be mounted at the restricting position when the auxiliary connector housing is at a proper mount position in the housing main body. However, the auxiliary connector housing is configured to interfere with the retainer and to prevent the retainer from being mounted to the restricting position when the auxiliary connector housing is displaced backward from the proper mount position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
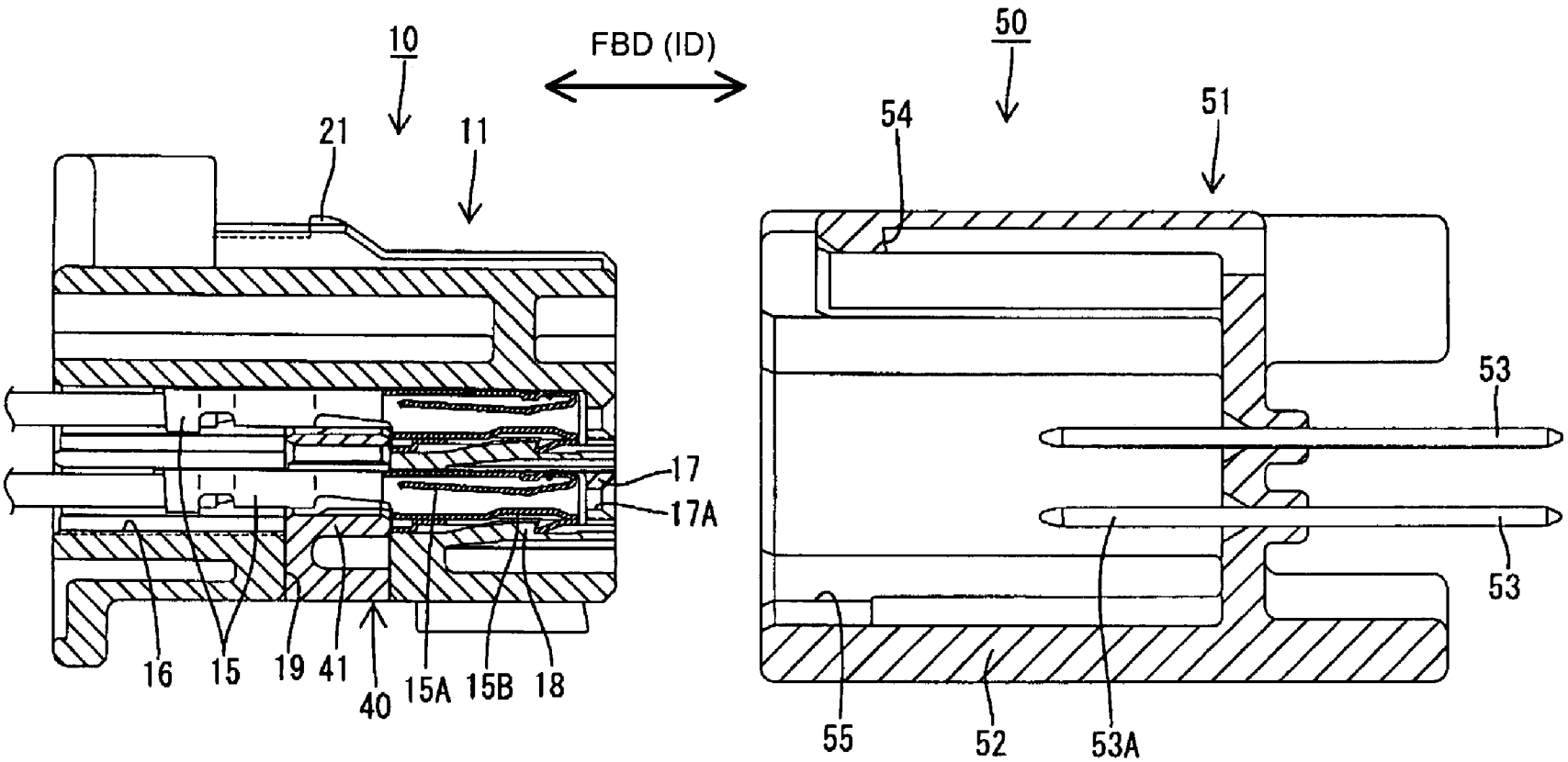
FIG. 1 is a side view in section showing a state before male and female connectors are connected in one embodiment of the invention.

A female divided connector according to the invention is identified generally by the numeral 10 in FIGS. 1 to 15. The divided connector 10 includes a housing main body 11, at least one auxiliary connector 30 to be accommodated in the housing main body 11, and two retainers 40 to be mounted into a lower part of the housing main body 11. The divided connector 10 is connectable with a male connector 50. In the following description, ends of the male and female connectors 50, 10 to be connected with each other are referred to as the front. Additionally, the terms upper and lower are provided as a convenient frame of reference, but are not intended to imply a required gravitational frame orientation.

Figure 2:
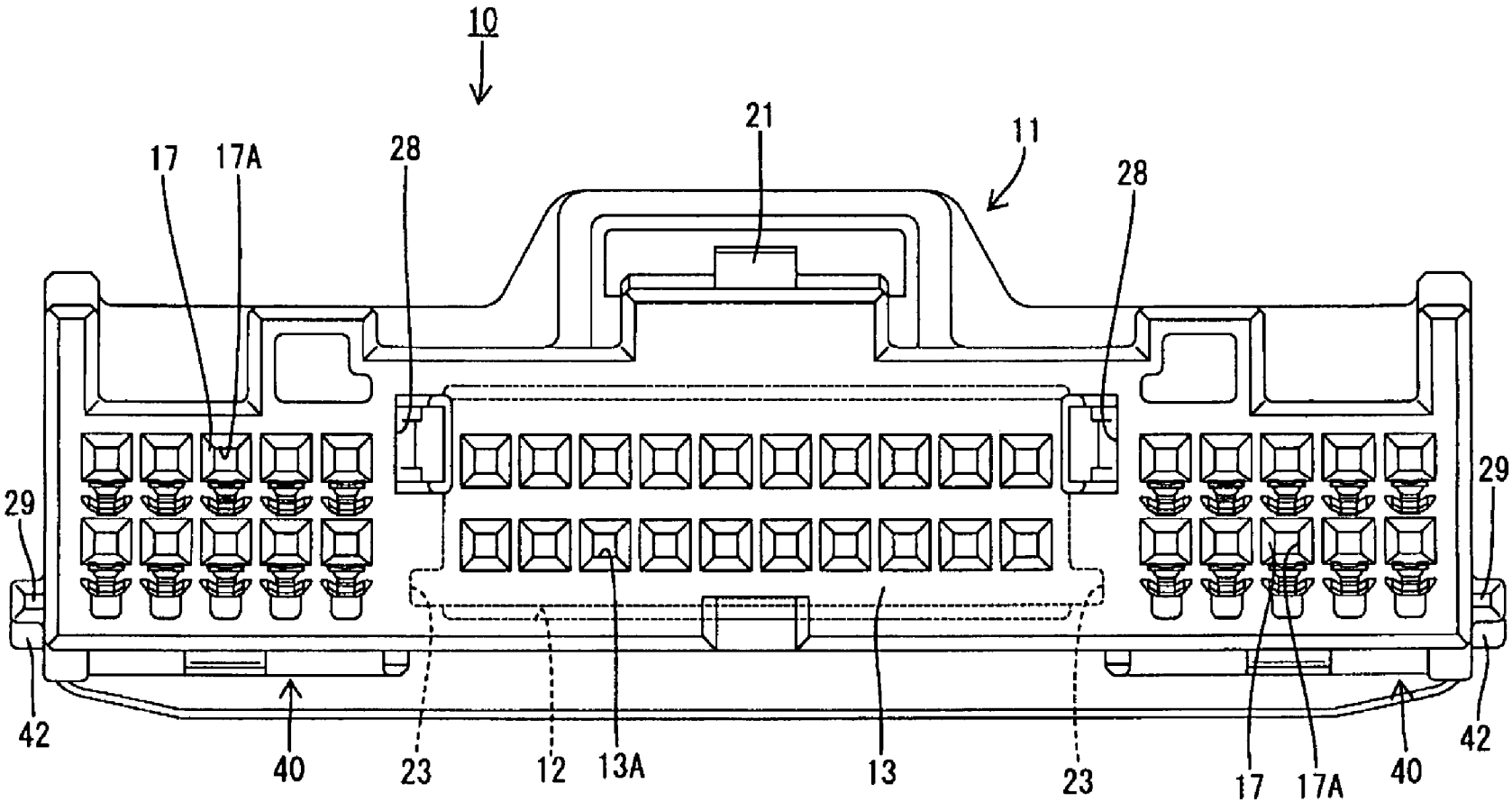
FIG. 2 is a front view of a housing main body.
Figure 3:
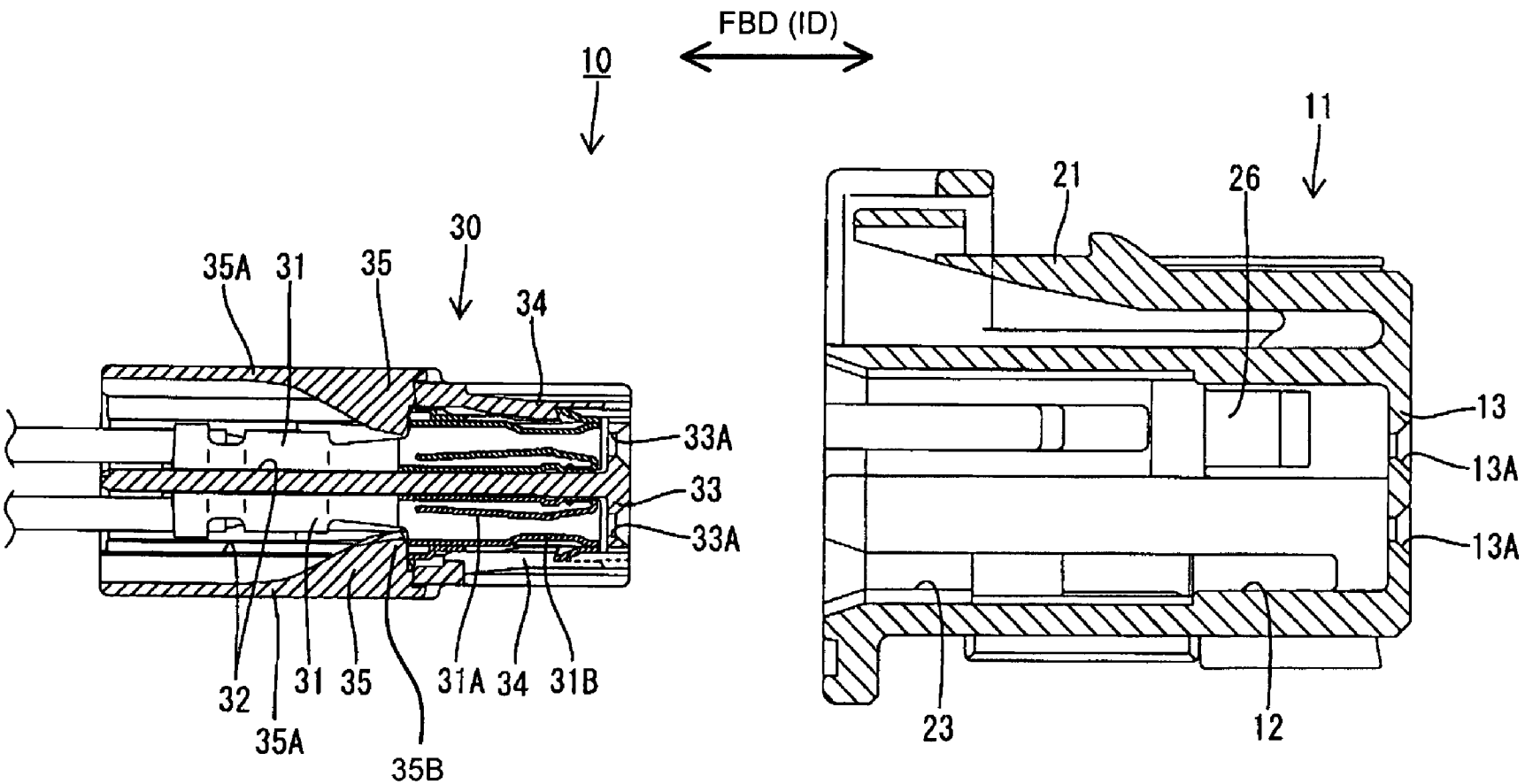
FIG. 3 is a side view in section showing a state before an auxiliary connector is assembled into the housing main body.
Figure 4:
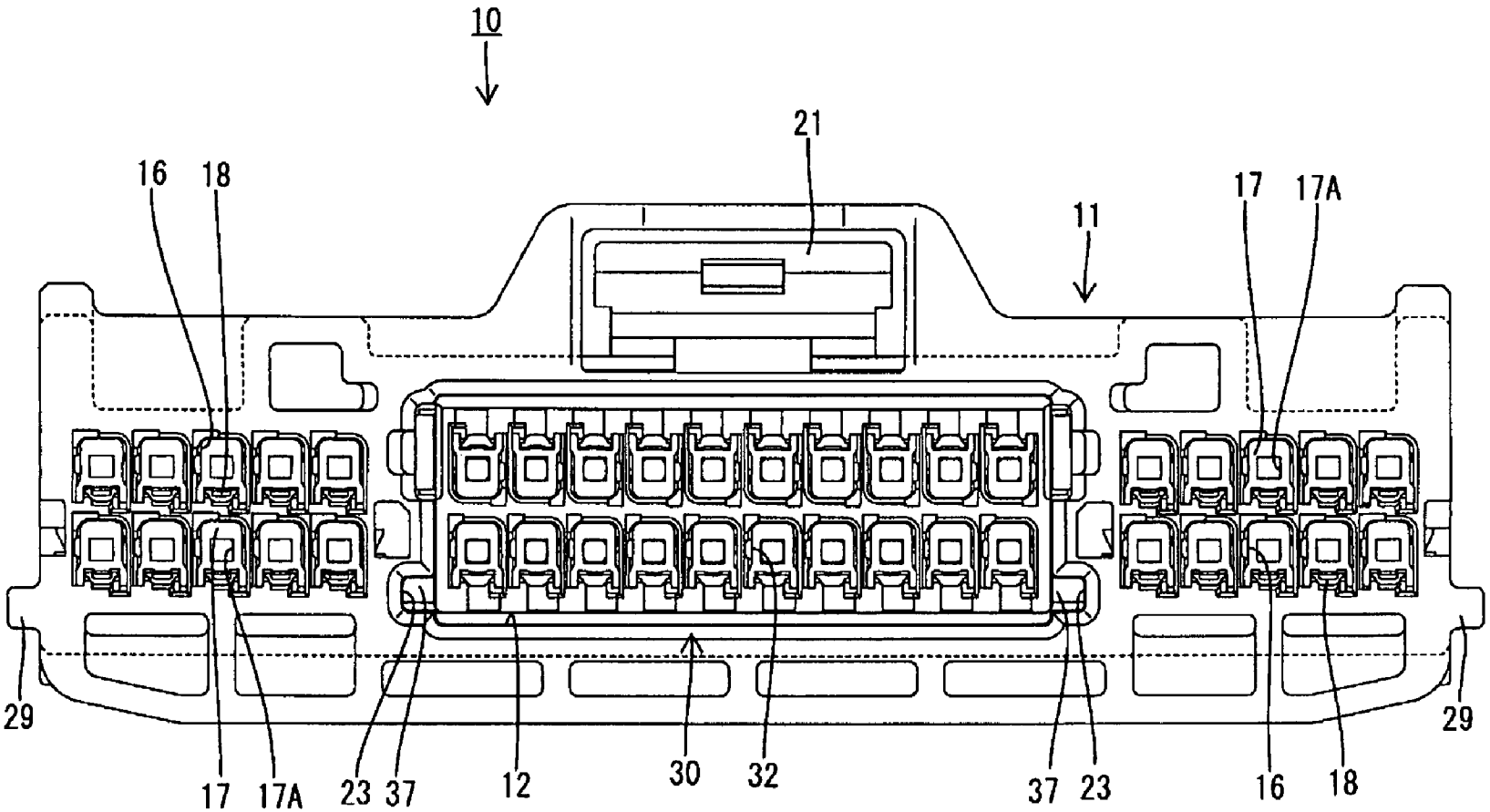
FIG. 4 is a rear view of the female connector.

The housing main body 11 is made e.g. of a synthetic resin and is in the form of a wide box. An accommodating portion 12 is formed in a widthwise intermediate portion of the housing main body 11 and has an open rear end, as shown in FIGS. 2 to 4. The auxiliary connector 30 can be inserted into the accommodating portion 12 in an insertion direction ID. A front wall 13 extends across the front surface of the accommodating portion 12 for stopping the auxiliary connector 30 at its front-end position, and tab insertion holes 13A penetrate the front wall 13 at positions corresponding to cavities 32 of the auxiliary connector 30. Cavities 16 are arranged in the housing main body 11 in arrays disposed symmetrically at opposite sides of the accommodating portion 12. Each array of cavities 16 has upper and lower stages. Female terminal fittings 15 are inserted into the cavities 16. Each female terminal fitting 15 has a resilient contact 15A at its front, and is electrically connectable with a male terminal fitting 53. More particularly, a tab 53A of the male terminal fitting 53 is insertable into a space between the resilient contact 15A and a receiving portion 15B that projects from the surface facing the resilient contact 15A. A front wall 17 is provided at the front end of each cavity 16 for stopping the female terminal fitting 15 at its front-end position, and a tab insertion hole 17A penetrates the front wall 17. The front walls 17 of the cavities 16 and the front wall 13 of the accommodating portion 12 substantially align at the front surface of the housing main body 11. However, the front walls 17 of the cavities 16 are slightly thicker than the front wall 13 of the housing main body (see FIG. 13). A lock 18 is provided on the bottom surface of each cavity 16 near the front end and is supported at both front and rear ends. The lock 18 is vertically resiliently deformable and engages the inserted female terminal fitting 15 for primary locking. Two retainer mount holes 19 are formed in the lower part of the housing main body 11 at positions corresponding to the groups of the cavities 16 and near middle portions with respect to forward and backward directions FBD (see FIG. 1). The retainers 40 are mounted from below into the retainer mount holes 19 in a direction intersecting the forward and backward directions FBD, preferably substantially normal thereto. Further, a vertically resiliently deformable lock arm 21 is cantilevered from a transverse intermediate position of the upper surface of the housing main body 11.

Figure 5:
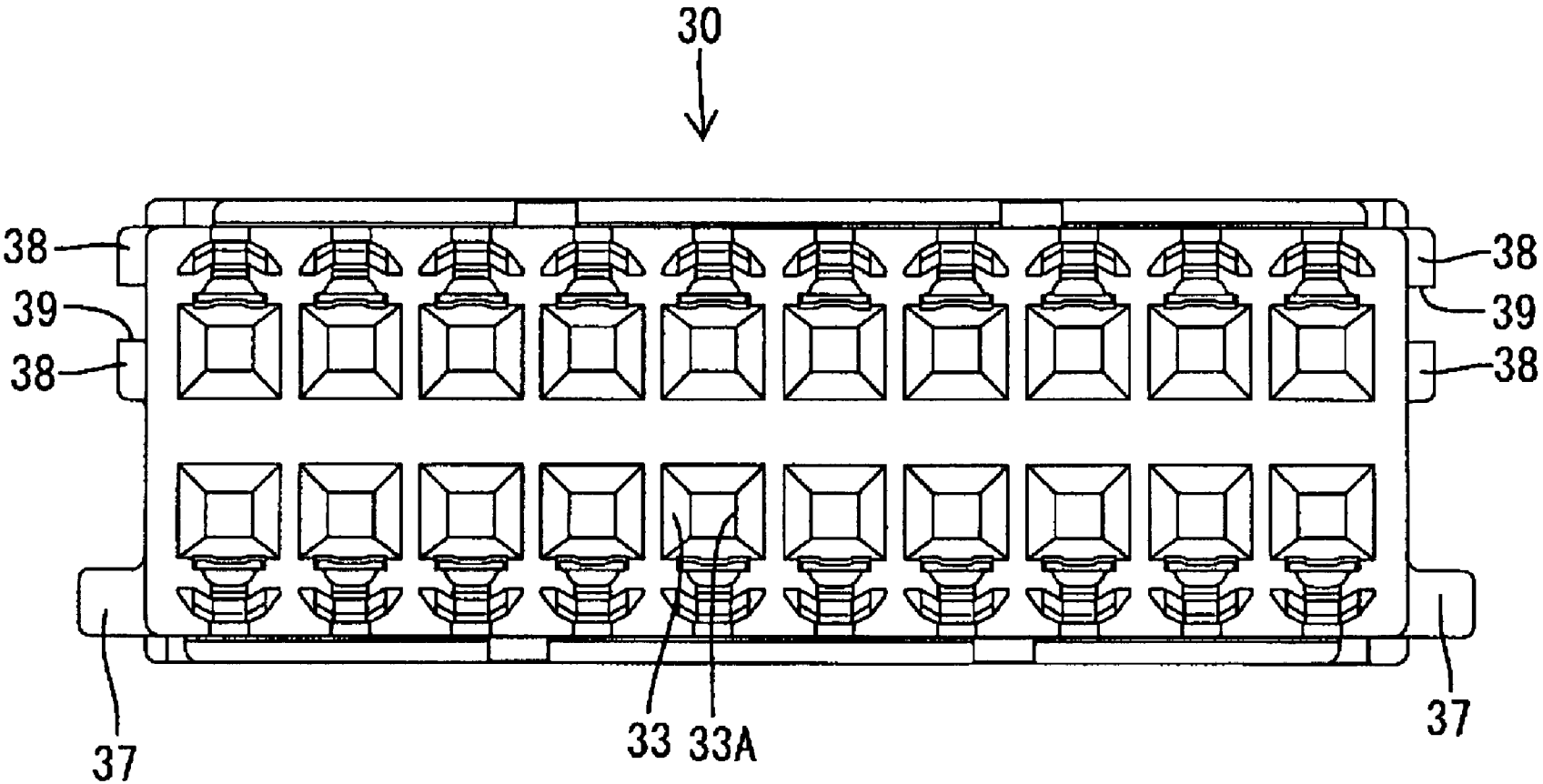
FIG. 5 is a front view of the auxiliary connector.

The auxiliary connector 30 is made e.g. of a synthetic resin and is in the form of a wide box that can be inserted from behind into the accommodating portion 12 of the housing main body 11, as shown in FIGS. 3 to 5. Cavities 32 are formed at upper and lower stages in the auxiliary connector 30 for receiving female terminal fittings 31. A resilient contact 31A is formed at the front of each female terminal fitting 31 and a receiving portion 31B projects from a surface facing the resilient contact 31A. A tab 53A of the male terminal fitting 53 can be received in a space between the resilient contact 31A and the receiving portion 31B to connect the female terminal fitting 31 electrically with the male terminal fitting 53. The female terminal fittings 31 are of the same kind as the female terminal fittings 15, and the number of female terminal fittings 15 equals the number of female terminal fittings 31. A front wall 33 is provided at the front end of each cavity 32 for stopping the female terminal fitting 31 at a front-end position, and tab insertion holes 33A penetrate the front wall 33 into the cavities 32. A resiliently deformable lock 34 is provided near the front of each cavity 32 and engages the inserted female terminal fitting 31 for primary locking. Retainers 35 are provided unitarily on the upper and lower surfaces of the auxiliary connector 30 via thin hinges 35A (see also FIG. 9) and can be opened and closed. The female terminal fittings 31 can be inserted in and withdrawn from the cavities 32 when the retainers 35 are opened. However, engaging projections 35B of the retainers 35 enter the cavities 32 (FIG. 3) to engage the female terminal fittings 31 when the retainers 35 are closed to lock the terminal fittings secondarily.

Figure 13:
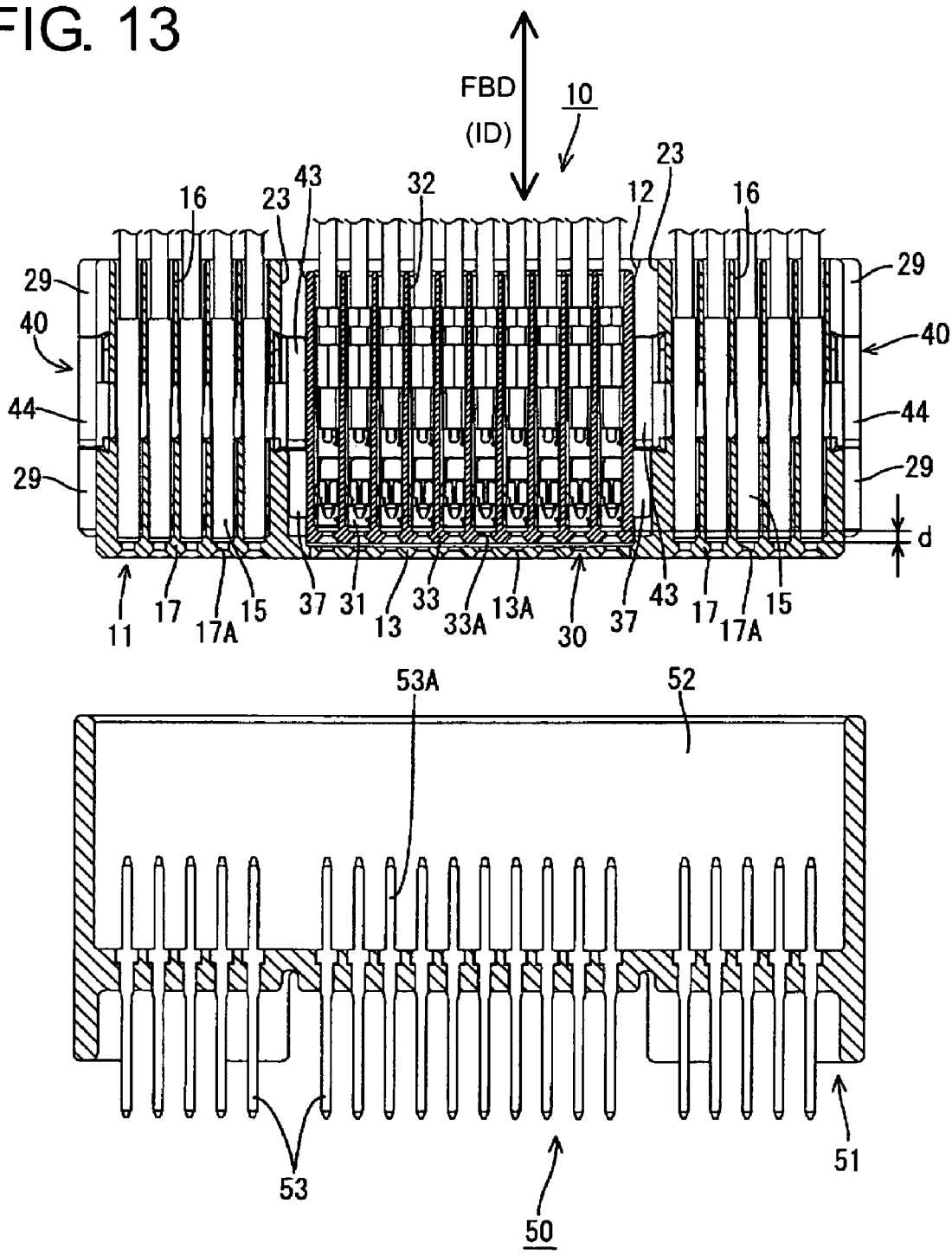
FIG. 13 is a plan view in section showing a state before the male and female connectors are connected.
Figure 14:
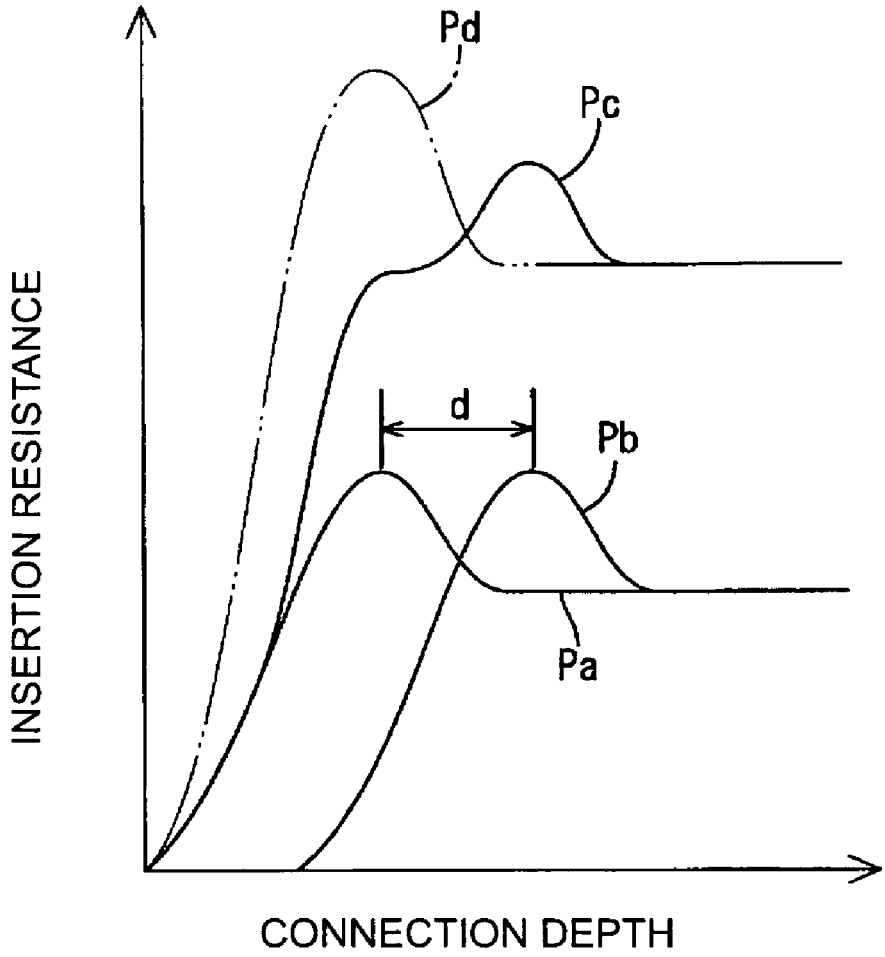
FIG. 14 is a graph showing transitions of insertion resistances created between male and female terminal fittings.

A sum of the thicknesses along the forward and backward directions FBD of the front wall of the accommodating portion 12 and the front wall 33 of each cavity 32 in the auxiliary connector 30 exceeds the thickness of the front walls 17 of the cavities 16 in the housing main body 11 by a dimension d (see e.g. FIG. 13). Thus, the female terminal fittings 31 in the cavities 32 of the auxiliary connector 30 are displaced along the forward and backward directions FBD from the female terminal fittings 15 in the housing main body 11 by the dimension d when the auxiliary connector 30 is inserted to a proper mount position where the front wall 33 of the auxiliary connector 30 contacts the front wall 13 of the accommodating portion 12, as shown in FIG. 13.

Figure 6A:
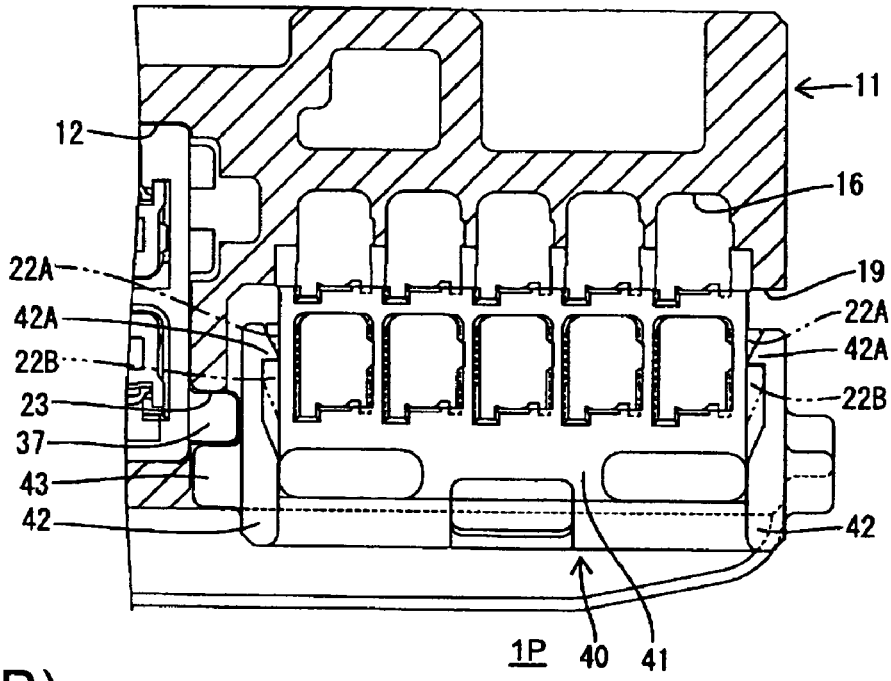
FIGS. 6(A) and 6(B) are partial enlarged sections showing a state where a retainer is mounted at a partial locking position and a state where the retainer is mounted at a full locking position, respectively.
Figure 6B:
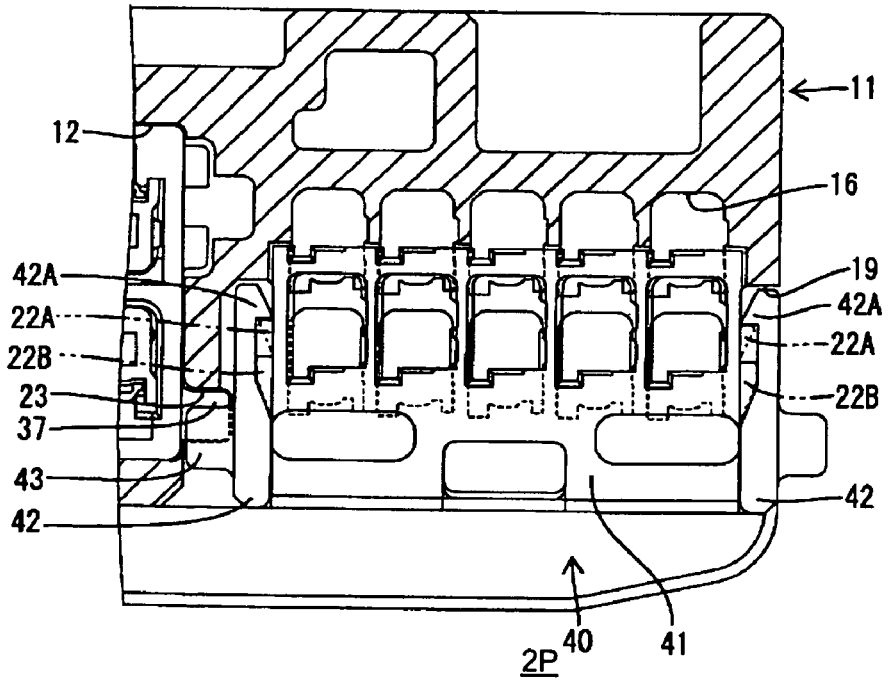
Figure 7:
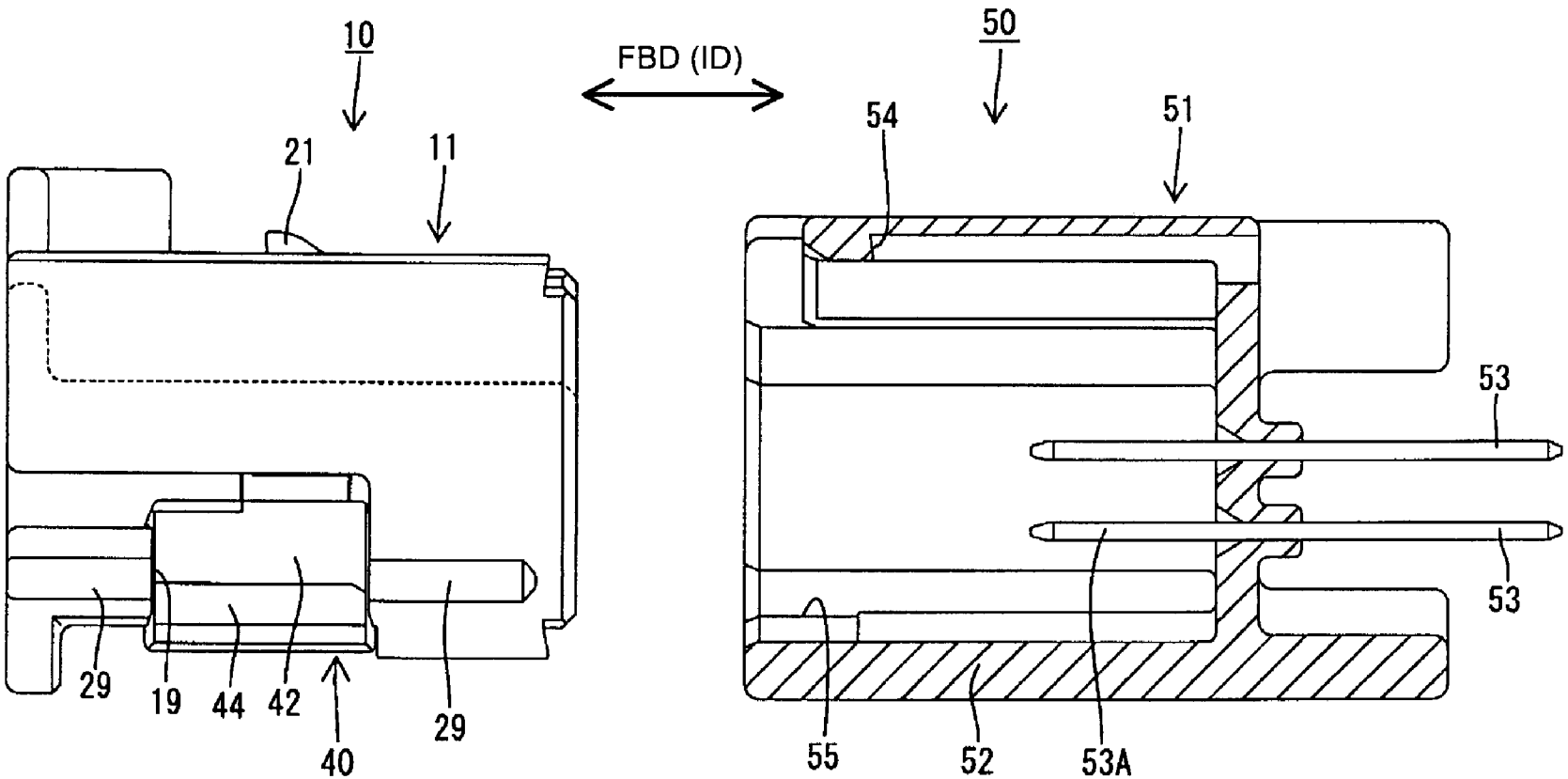
FIG. 7 is a side view in section of the male and female connectors when the retainer is located at the partial locking position.

Each retainer 40 is made e.g. of a synthetic resin and has a lattice-shaped main body 41. Plate-shaped sidewalls 42 extend from opposite left and right edges of the main body 41 along forward and backward directions FBD, as shown in FIGS. 1, 6 and 7. The retainer 40 can be held at a partial locking position 1P having a short depth of insertion (see FIG. 6(A)) and a full locking position 2P having a long depth of insertion (see FIG. 6(B)) by engaging locking claws 42A at the inner surfaces of the upper ends of the side walls 42 with locking projections 22A, 22B on the surfaces of the housing main body 11 facing the retainer mount hole 19. The main body 41 of the retainer 40 is retracted from the cavities 16 to permit insertion and withdrawal of the female terminal fittings 15 at the partial locking position 1P. However, the main body 41 enters the cavities 16 to lock the female terminal fittings 15 and to prevent the female terminal fittings 15 from coming out at the full locking position 2P.

Figure 8A:
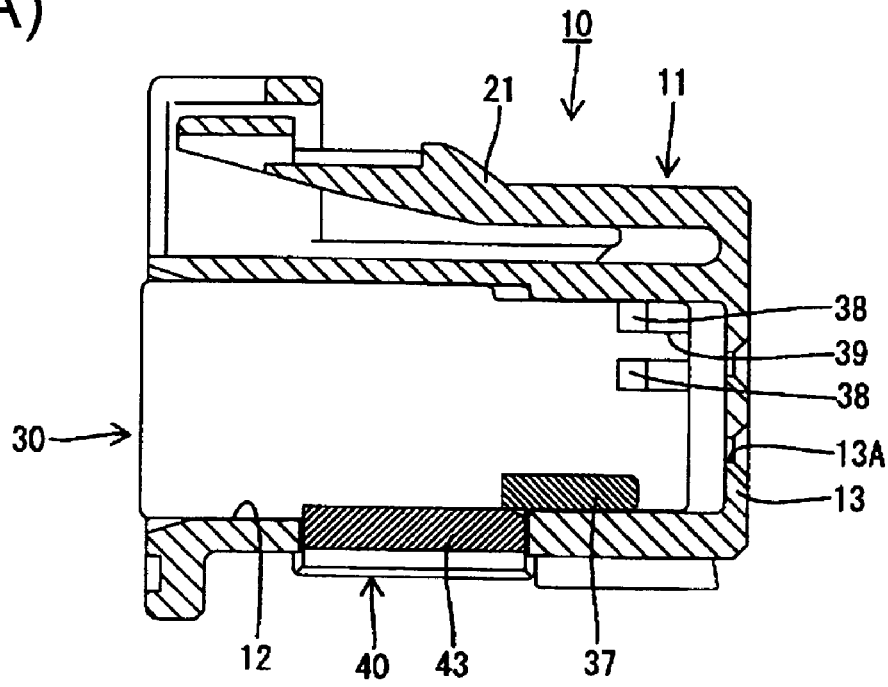
FIGS. 8(A) and 8(B) are side views in section showing a state where a movement of the retainer by pushing is prevented and a state where the retainer is pushed to the full locking position.
Figure 8B:
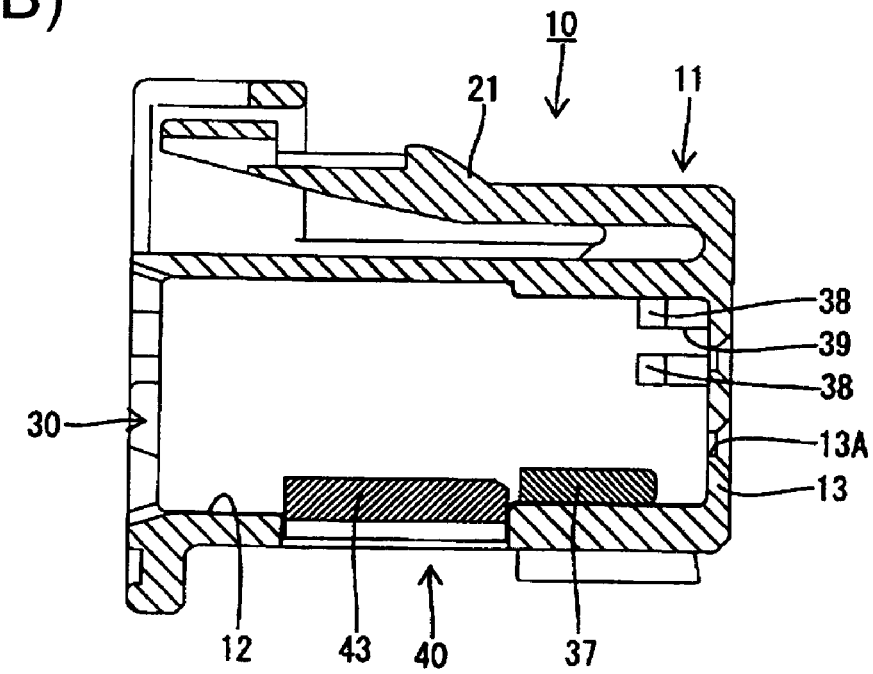

Error insertion preventing ribs 37 project near the front end at each of the left and right surfaces of the auxiliary connector 30 and extend parallel to the forward and backward directions FBD (see e.g. FIGS. 7 and 8). Error preventing grooves 23 extend along forward and backward directions FBD at the bottom of the inner side surfaces of the accommodating portion 12 in the housing main body 11 (see FIG. 4) and receive the error insertion preventing ribs 37. The error insertion preventing ribs 37 and the error insertion preventing grooves 23 prevent upside-down insertion of the auxiliary connector 30. Detecting ribs 43 project at a bottom part of the outer surface of the side wall 42 of each retainer 40 closer to the accommodating portion 12 (see FIGS. 6 and 8) and extend along forward and backward directions FBD. The detecting ribs 43 enter the error insertion preventing grooves 23 of the accommodating portion 12 in the housing main body 11 when the retainer 40 is at the full locking position 2P (see FIG. 6(B)), but are retracted from them when the retainer 40 is at the partial locking position 1P (see FIG. 6(A)). The error insertion preventing ribs 37 of the auxiliary connector 30 do not interfere with the detecting ribs 43 of the retainer 40 when the auxiliary connector 30 is at the proper mount position (see FIG. 8(B)). Thus, the retainer 40 can move from the partial locking position 1P to the full locking position 2P. However, the error insertion preventing ribs 37 interfere with the detecting ribs 43 when the auxiliary housing 30 is displaced back from the proper mount position. Thus, the retainer 40 cannot be pushed to the full locking position 2P (see FIG. 8(A)).

Figure 9:
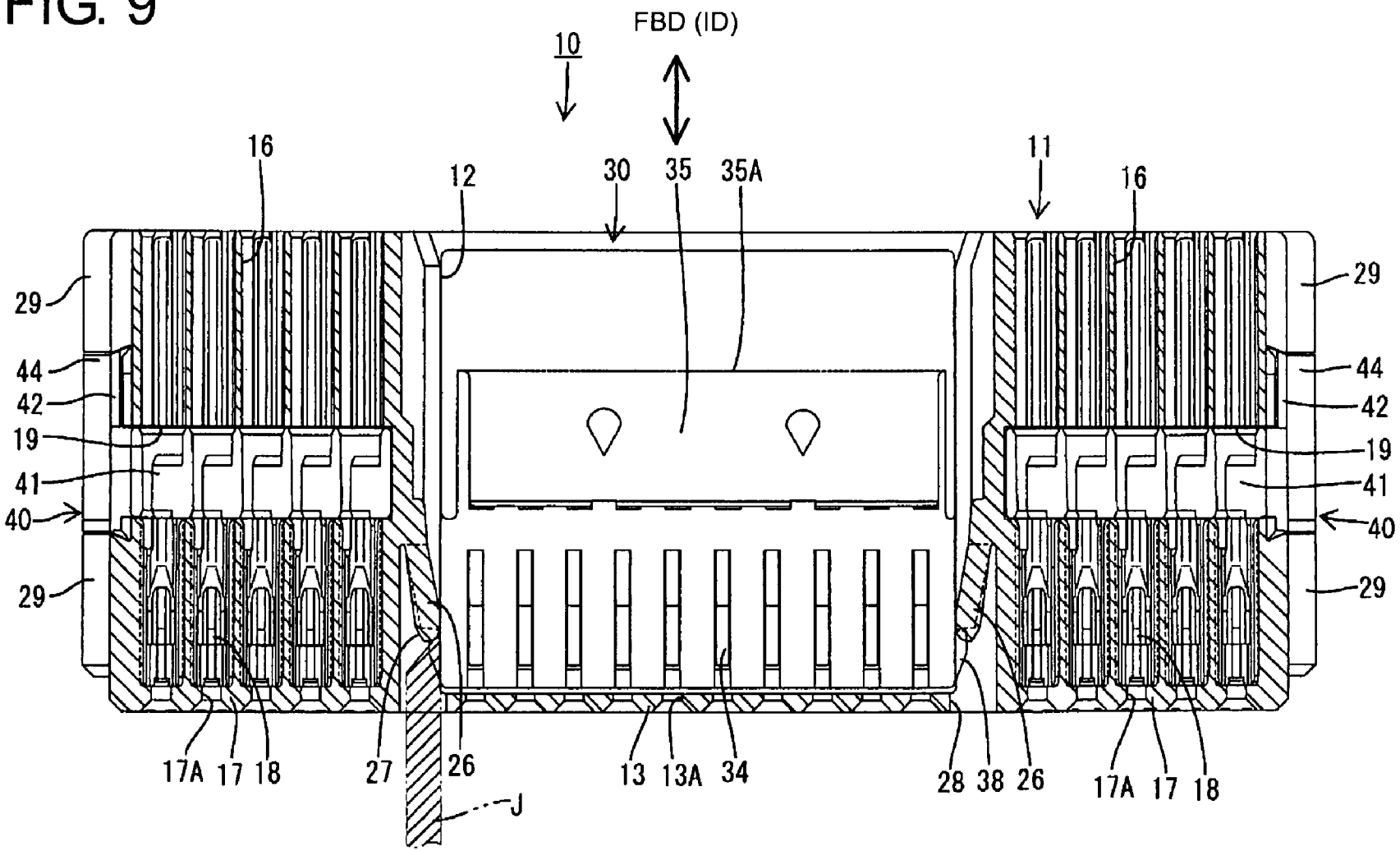
FIG. 9 is a plan view in section showing a state where a jig for unlocking the auxiliary connector is inserted.
Figure 10:
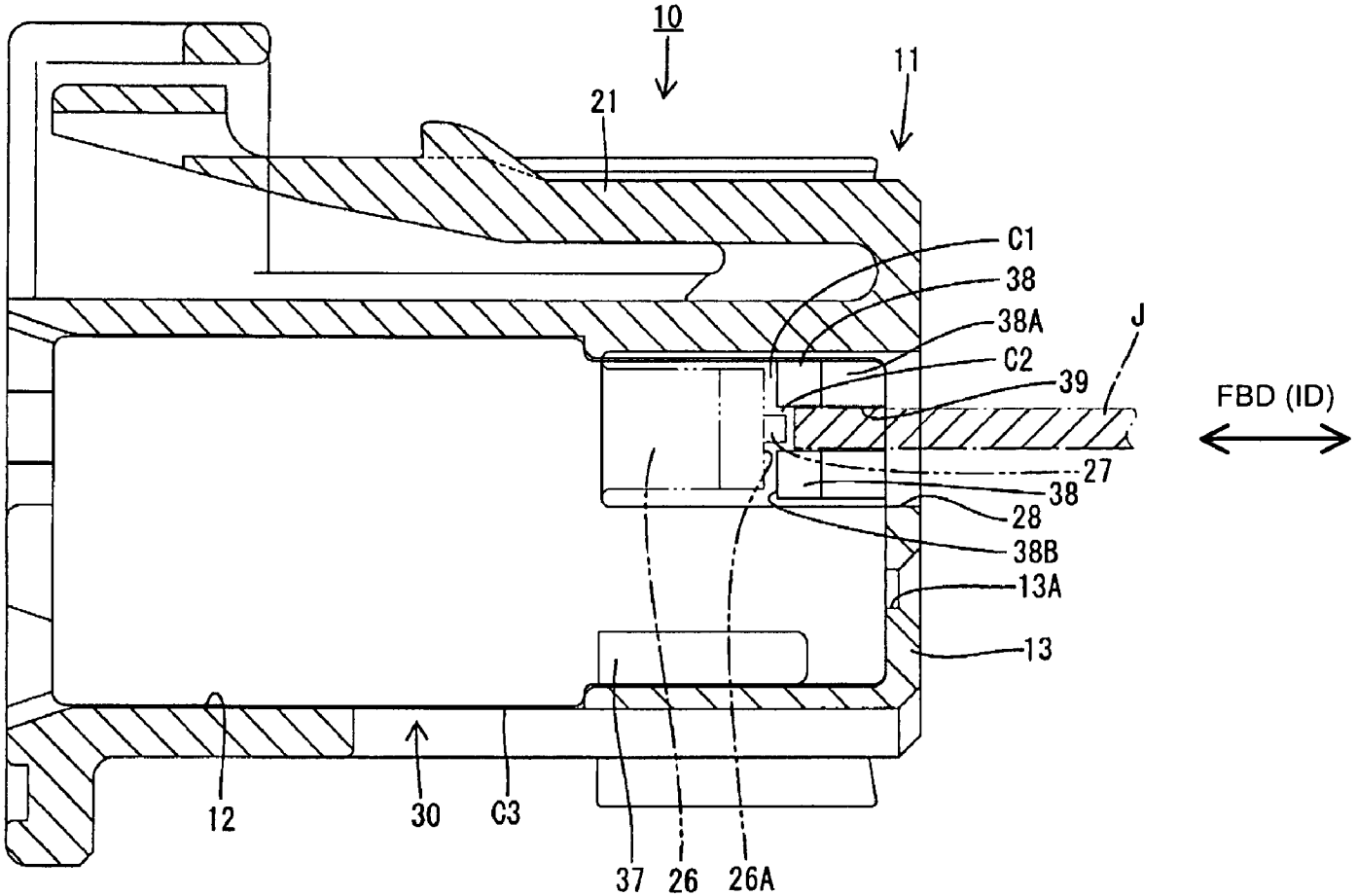
FIG. 10 is a side view in section showing a state where the jig for unlocking the auxiliary connector is inserted.

As shown in FIGS. 9 to 11, resiliently deformable plate-shaped locking pieces 26 extend obliquely in toward the front at upper parts of the inner left and right surfaces of the accommodating portion 12 of the housing main body 11. Each locking piece 26 is transversely deformable away from the auxiliary housing 30. A locking surface 26A is formed at the leading end of the locking piece 26 and is inclined in towards the front with respect to an insertion direction ID of the auxiliary housing 30 into the accommodating portion 12.

Vertically spaced upper and lower locking projections 38 are formed at the front upper end of each of the opposite side surfaces of the auxiliary connector 30 and a groove 39 extends forward and backward therebetween. A moderately sloped guiding surface 38A is formed at the front of each locking projection 38, and an undercut locking surface 38B is at the rear surface thereof. The locking surface 26A of the lock 26 is engageable with the locking surface 38B. A disengaging projection 27 projects substantially in the vertical middle of the locking surface 26A of each lock 26. The disengaging projection 27 enters a clearance between the upper and lower locking projections 38 when the locking surface 26A engages the locking surfaces 38B of the locking projections 38. The disengaging projection 27 is dimensioned so as not to bulge out of a thickness range of the locking surface 26A. An introducing surface 27A is formed on the disengaging projection 27A and is rounded convexly towards the accommodating portion 12. The lock 26 can be deformed resiliently in unlocking direction ULD intersecting the forward and backward directions FBD by inserting the leading end of a jig J into a clearance between the introducing surface 27A and the side surface of the auxiliary connector 30 while the lock 26 is engaged with the locking projections 38. Unlocking windows 28 are formed in the front wall 13 of the housing main body 11 at positions before the locks 26 for receiving the jig J. As shown in FIG. 10, a clearance C1 is defined along forward and backward directions FBD between the locking surface 26A of the lock 26 and the locking projections 38. Further, clearances C2 are defined along the widthwise direction of the groove 39 (vertical direction or a direction substantially normal to the forward and backward directions FBD) between the disengaging projection 27 and the locking projections 38. The clearances C2 are larger than clearances C3 defined along the widthwise direction of the groove 39 (vertical direction or a direction substantially normal to the forward and backward directions FBD) between the auxiliary connector 30 and the accommodating portion 12.

As shown in FIG. 7, error connection preventing ribs 29 project substantially along a connecting direction of the female connector 10 with the male connector 50 on lower parts of substantially opposite left and right surfaces of the housing main body 11. Each error connection preventing rib 29 has front and rear sections at opposite sides of the retainer mount hole 19. On the other hand, error connection preventing ribs 44 extend substantially along forward and backward directions FBD on the outer surfaces of the outer side walls 42 of the respective retainers 40. The error connection preventing ribs 44 align with the error connection preventing ribs 29 of the housing main body 11 substantially along the connecting direction when the retainer 40 is at the full locking position 2P. However, the error connection preventing ribs 44 are displaced down substantially normal to the forward and backward directions FBD from the error connection preventing ribs 29 of the housing main body 11 when the retainer 40 is at the partial locking position 1P.

Figure 12:
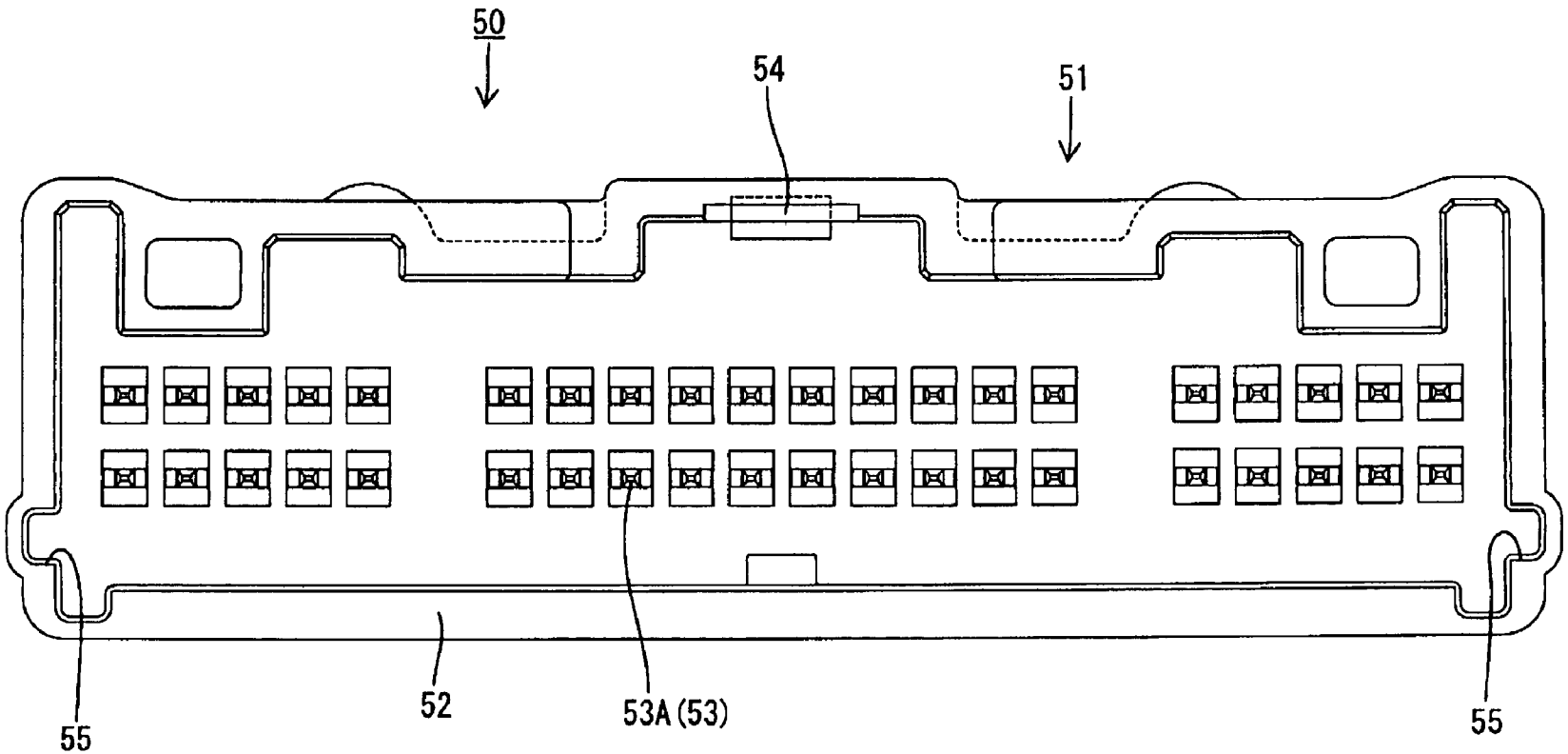
FIG. 12 is a front view of the male connector.

The male connector 50 includes a male housing 51 made e.g. of a synthetic resin as shown in FIGS. 7, 12 and 13. A fitting portion 52 in the form of a wide receptacle is provided on the front surface of the male housing 51, and the female connector 10 is fittable into the fitting portion 52. Male terminal fittings 53 are pressed into the back end surface of the fitting portion 52 at positions corresponding to the respective cavities 16, 32 of the female connector 10. Each male terminal fitting 53 includes a tab 53A projecting into the fitting portion 52. Projecting distances of the tabs 53A from the back end surface of the fitting portion 52 all are substantially equal. A receiving portion 54 is formed substantially in the transverse center of the ceiling of the fitting portion 52 and is engageable with the lock arm 21 of the housing main body 11 to lock the male and female housings 51, 11 in their properly connected state. Error connection preventing grooves 55 are formed along forward and backward directions FBD at lower parts of the opposite left and right inner surfaces of the fitting portion 52 for receiving the error connection preventing ribs 29, 44 of the housing main body 11 and the retainer 40. The error connection preventing ribs 29, 44 and the error connection preventing grooves 55 prevent upside-down insertion of the male connector 10.

The auxiliary connector 30 is assembled by inserting the female terminal fittings 31 into the corresponding cavities 32 and then closing the retainers 35 to doubly lock the female terminal fittings 31 (see FIG. 3).

The retainers 40 then are mounted at their partial locking positions 1P in the housing main body 11, and the auxiliary connector 30 is inserted along the inserting direction ID into the accommodating portion 12 from behind. An attempt may be made to insert the auxiliary connector 30 upside down. However, the error insertion preventing ribs 37 will catch the opening edge of the accommodating portion 12 to hinder the insertion and to detect the erroneous orientation. The guiding surfaces 38A of the locking projections 38 on the properly oriented auxiliary connector 30 contact the locks 26 as the insertion progresses and deform the locks 26 out in the direction ULD. The front wall 33 of the auxiliary connector 30 contacts the front wall 13 of the accommodating portion 12 when the auxiliary connector 30 is inserted to the proper mount position. At this time, the locking pieces 26 are restored resiliently inward and the locking surfaces 26A thereof engage the locking surfaces 38B of the locking projections 38. Thus, the auxiliary connector 30 is locked so as not to come out (see FIG. 9). At this time, the disengaging projections 27 enter the corresponding grooves 39.

The female terminal fittings 15 subsequently are inserted into the corresponding cavities 16 of the housing main body 11, and each retainer 40 is pushed from the partial locking position 1P to the full locking position 2P. The retainer 40 could be pushed before the auxiliary connector 30 reaches the proper mount position. However, the detecting rib 43 of the retainer 40 contacts the error insertion preventing rib 37 in the error insertion preventing groove 23, as shown in FIG. 8(A). Accordingly, the retainer 40 cannot be pushed to the full locking position 2P and the insufficient insertion of the auxiliary connector 30 is detected. The retainer 40 is an existing construction that is utilized to detect the insufficiently inserted state of the auxiliary connector 30. Thus, the insufficiently inserted state of the auxiliary connector 30 can be detected without increasing the number of parts.

The retainer 40 can be pushed to the full locking position 2P when the auxiliary connector 30 is at the proper mount position. Thus, the detecting rib 43 enters the error insertion-preventing groove 23 without interfering with the error insertion preventing rib 37 of the auxiliary connector 30 (FIG. 8(B)). As a result, the retainer 40 reaches the full locking position 2P and doubly locks the female terminal fittings 15 in the cavities 16. Additionally, the detecting rib 43 engages the rear surface of the error insertion preventing rib 37 of the auxiliary connector 30 and doubly locks the auxiliary connector 30. In this way, assembly of the female connector 10 is completed.

Next, the male and female connectors 50, 10 are opposed to each other, as shown in FIGS. 1 and 13. The female connector 10 then is fit into the fitting portion 52 and the error connection preventing ribs 29 of the housing main body 11 enter the error connection preventing grooves 55 of the male housing 51. Here, the error connection preventing ribs 29 of the housing main body 11 and the error connection preventing ribs 44 of the retainers 40 align, if the retainers 40 are pushed properly to their full locking positions 2P. As a result, the error connection preventing ribs 29, 44 enter the error connection preventing grooves 55 of the male housing 51 to continue the fitting operation. On the other hand, a retainer 40 may be left at the partial locking position 1P. This may occur if it was forgotten to push the retainers 40 to the full locking positions 2P or if the retainers 40 cannot be pushed to the full locking positions 2P because the auxiliary connector 30 is inserted insufficiently. An attempt could be made to connect the male and female connectors 10, 50 in this state. However, the error connection preventing ribs 44 of the retainers 40 are displaced from the error connection preventing ribs 29 of the housing main body 11 and interfere with the opening edge of the fitting portion 52 to prevent further connection. In this way, the insufficient insertion of the retainers 40 is detected.

As the connection of the male and female connectors 50, 10 deepens, the tabs 53A of the male terminal fittings 53 enter the cavities 16, 32 through the tab insertion holes 17A of the front walls 17 or through the tab insertion holes 13A of the front wall 13 and the tab insertion holes 33A of the front walls 33. The female terminal fittings 31 in the auxiliary connector 30 are located behind the female terminal fittings 15 in the housing main body 11 by the dimension d. Thus, the tabs 53A having entered the cavities 16 of the housing main body 11 are inserted first into the female terminal fittings 15. Subsequently the tabs 53A, having entered the cavities 32 of the auxiliary connector 30, are inserted into the female terminal fittings 31. An insertion resistance Pa between the male and female terminal fittings 53, 15 suddenly increases to a peak value due to resilient restoring forces of the resilient contact pieces 15A immediately after the contact of the leading ends of the tabs 53A with the resilient contact pieces 15A. The insertion resistance Pa then decreases and the deformation of the resilient contact pieces 15A stops being held in sliding contact with the tabs 53A. Thus, the insertion resistance Pa becomes substantially stable at a low value (e.g. less than about ¾ of the peak value). An insertion resistance Pb between the female terminal fittings 31 in the auxiliary connector 30 and the tabs 53A shows a tendency similar to the insertion resistance Pa, but reaches its peak value later because the female terminal fittings 31 are displaced back from the female terminal fittings 15 by the distance d. An insertion resistance Pc between the tabs 53A and the corresponding female terminal fittings 15, 31 is a sum of the insertion resistance Pa between the female terminal fittings 15 and the tabs 53A and the insertion resistance Pb between the female terminal fittings 31 and the tabs 53A. A peak value thereof is lower than a peak value of an assumed insertion resistance Pd (about twofold of Pa) that would occur if the female terminal fittings 31 started contacting the tabs 53A at the same time as the female terminal fittings 15. Thus, a peak value of a connection resistance between the male and female connectors 50, 10 is reduced.

Figure 15:
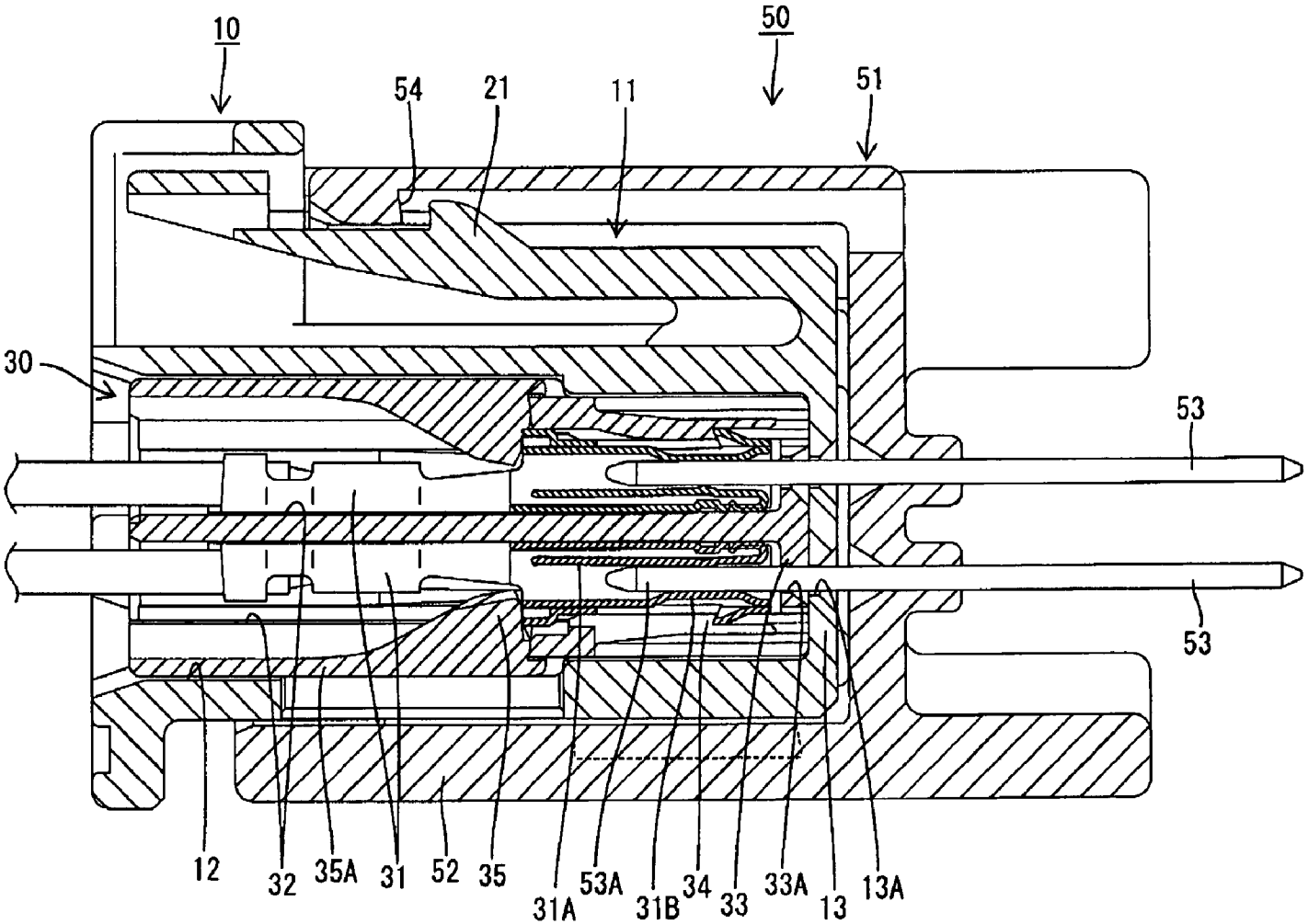
FIG. 15 is a side view in section showing a state where the male and female connectors are properly connected.
Figure 16:
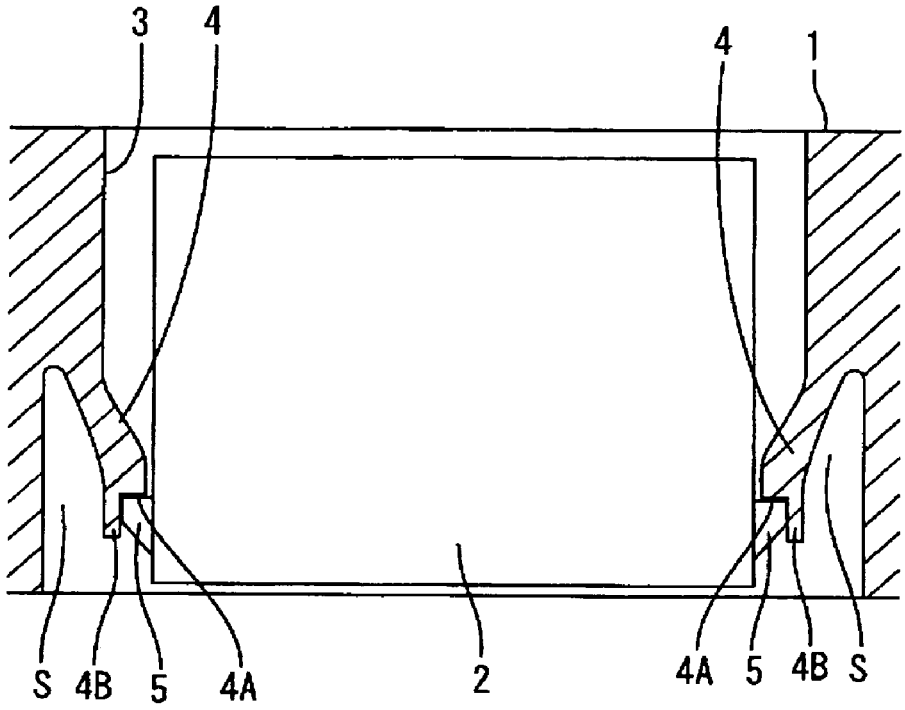
FIG. 16 PRIOR ART
FIG. 16 is a section showing a prior art divided connector.

The female connector 10 is pushed to the back wall of the fitting portion 52. Thus, the lock arm 21 engages the receiving portion 54 to lock the housings 51, 11 in their properly connected state as shown in FIG. 15.

Figure 11B:
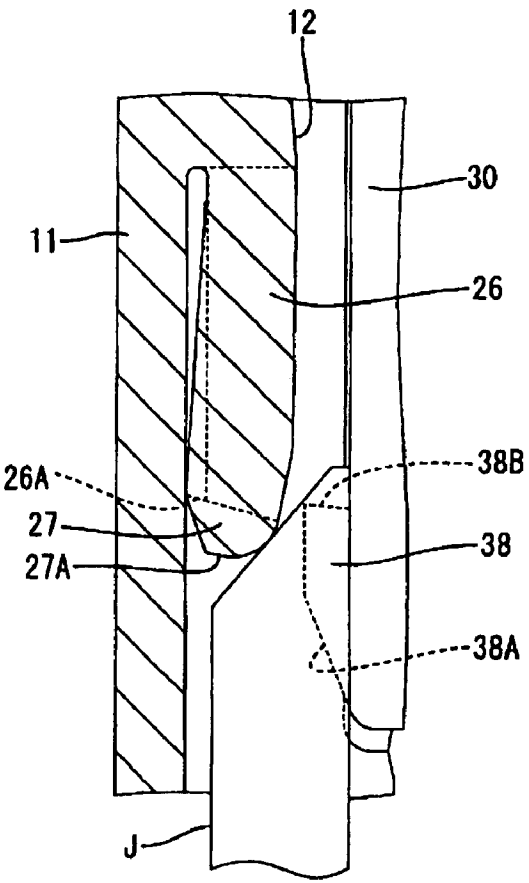
FIGS. 11(A) and 11(B) are partial enlarged plan views in section showing a state where the jig is in contact with a locking piece and a state where the locking piece is unlocked by the jig.
Figure 11A:
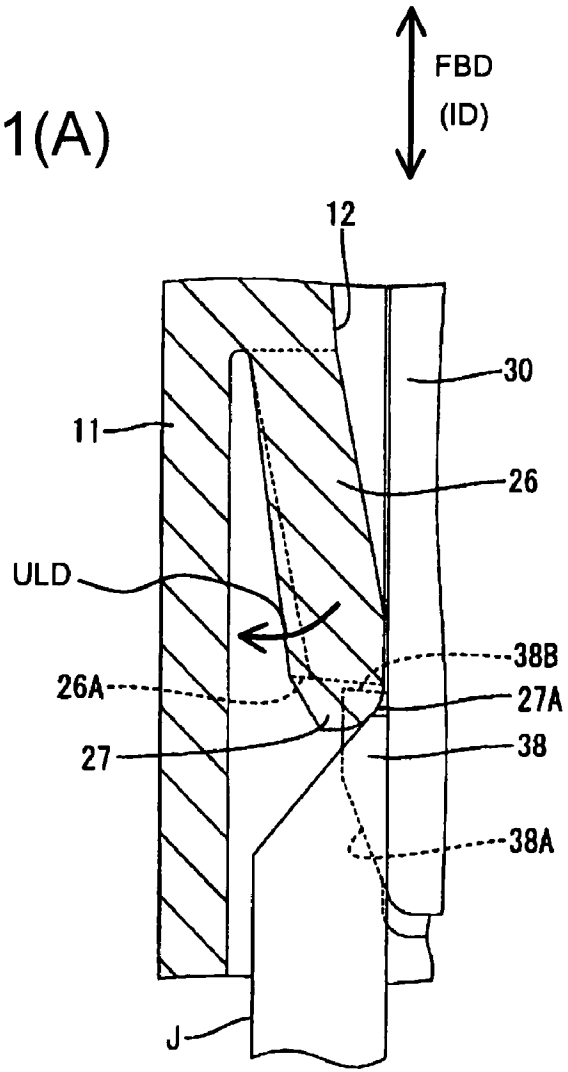

The auxiliary connector 30 may have to be detached from the housing main body 11 for maintenance or other reason. Thus, the retainers 40 are pushed from the full locking positions 2P to the partial locking positions 1P. Subsequently, as shown in FIGS. 9 and 10, the pointed end of a jig J is inserted into the unlocking window 28 of the housing main body 11. The leading end of the jig J is fit into the groove 39 between the upper and lower locking projections 38 and slides towards the back. The leading end of the jig J then enters the clearance between the guiding surface 27A of the disengaging projection 27 and the side surface of the auxiliary connector 30 to contact the introducing surface 27A, as shown in FIG. 11(A). Here, the jig J is guided by the groove 39 formed between the pair of locking projections 38 to a position to contact the disengaging projection 27. Thus, operability is good.

The jig J is pushed further towards the back. Thus, the lock 26 is guided by the introducing surface 27A of the disengaging projection 27 and deforms resiliently in the unlocking direction ULD towards a side away from the side surface of the auxiliary connector 30, as shown in FIG. 11(B). Thus, the locking surface 26A of the lock 26 and the locking surface 38B of the locking projection 38 disengage. The auxiliary connector 30 can be pulled back out of the accommodating portion 12 with respect to the housing main body 11 after the left and right locks 26 are disengaged.

As described above, the disengaging projection 27 in the grooves 39 is pressed and disengaged by the jig J to resiliently deform the lock 26 so that the lock 26 can be disengaged from the locking projections 38. The length of the lock 26 can be reduced because, unlike the prior art, it is unnecessary to cause the disengaging projection 27 to project more forward than the locking projections 38. Further, the thickness of the leading end of the lock 26 can be made smaller since it is unnecessary to displace the disengaging projection from the locking surface 26A along the thickness direction. Accordingly, the deformation space for the lock 26 can be smaller, which enables the miniaturization of the housing main body 11 and the miniaturization of the male and female connectors 50, 10. Material would be taken out of the lock 26 and the strength of the lock 26 would be reduced if a recess for receiving the leading end of the jig J was formed in the locking surface 26A of the lock 26 instead of in the disengaging projection 27. However, the disengaging projection 27 projects from the locking surface 26A in this embodiment, and the strength of the lock 26 is not reduced.

The disengaging projection 27 has the introducing surface 27A. Thus, the lock 26 is guided by the introducing surface 27A and is deformed in the unlocking direction ULD from the locking projections 38 by bringing the leading end of the jig J into contact with the introducing surface 27A to push the disengaging projection 27 backward. Thus, operational efficiency is good because unlocking can be effected merely by pushing the jig J.

The clearances C2 between the disengaging projections 27 and the wall surfaces of the grooves 39 (locking projections 38) are larger than the clearances C3 between the auxiliary connector 30 and the wall surfaces of the accommodating portion 12 with respect to the widthwise direction of the grooves 39. Thus, the disengaging projections 27 will not interfere with the wall surfaces of the grooves 39 to hinder the movements of the locks 26 upon engaging the locks 26 with the locking projections 38. Therefore, locking can be securely effected.

The invention is not limited to the above-described embodiment. For example, the following embodiments also are embraced by the invention. Beside the following embodiments, various changes can be made without departing from the scope and spirit of the invention as defined by the claims.

The invention also is applicable to male connectors accommodating male terminal fittings.

The invention is not limited to divided connectors using only terminal fittings of the same shape as in the foregoing embodiment, but is also applicable to divided connectors of hybrid type using a plurality of kinds of terminal fittings having different shapes.

Although the housing main body is provided with the cavities into which the terminal fittings are mountable in the foregoing embodiment, it may be a frame having no cavity according to the present invention.

Plural auxiliary housings may be mounted in the housing main body.

What is claimed is:

1. A divided connector with a housing main body having at least one accommodating portion, at least one auxiliary housing insertable into the accommodating portion from an inserting direction, comprising:

at least one resiliently deformable lock cantilevered from an inner wall of the accommodating portion and having a leading end formed with a locking surface;

a locking projection on a side surface of the auxiliary housing, the locking surface being engageable with a rear surface of the locking projection to prevent the auxiliary housing from coming out;

at least one groove formed in the locking projection for receiving a jig; and a disengaging projection projecting from the locking surface of the lock and being located in the groove when the locking surface and the locking projection engage one another, wherein the locking surface is disengageable from the locking projection by pressing the jig against the disengaging projection in the groove to resiliently deform the lock.

2. The divided connector of claim 1, wherein the disengaging projection is formed with an introducing surface inclined to introduce a leading end of the jig into a clearance between the disengaging projection and the side surface of the auxiliary housing.

3. The divided connector of claim 1, wherein a clearance between the disengaging projection and a wall surface of the groove along a widthwise direction of the groove exceeds a clearance between the auxiliary housing and a wall surface of the accommodating portion substantially along the widthwise direction of the groove.

4. The divided connector of claim 1, wherein a clearance is defined along forward and backward directions between the locking surface of the lock and the locking projections.

5. The divided connector of claim 1, wherein a rear surface of the locking projection is undercut to bulge out towards the leading end thereof.

6. The divided connector of claim 1, wherein the housing main body has at least one cavity for receiving at least one main-body terminal fitting.

7. The divided connector of claim 6, further comprising a retainer to be mounted at a restricting position in the housing main body to lock the main-body terminal fittings in the housing main body.

8. The divided connector of claim 7, wherein the auxiliary housing is configured to avoid interference with the retainer and to permit the retainer to be mounted at the restricting position when the auxiliary housing is at a proper mount position in the housing main body, the auxiliary housing further being configured to interfere with the retainer and to prevent the retainer from being mounted to the restricting position when the auxiliary housing is displaced backward from the proper mount position.

9. A divided connector comprising:

a housing main body having opposite front and rear ends, an accommodating recess extending forwardly into the rear end, at least one resiliently deformable lock cantilevered forwardly from an inner wall of the accommodating recess and having a front end, the front end of the lock including two spaced-apart locking surfaces, a disengaging projection projecting forward from the front end of the lock beyond the locking surfaces and from a position between the spaced-apart locking surfaces, an unlocking window being formed in the front of the housing main body and aligned with the disengaging projection; and an auxiliary housing insertable forwardly into the accommodating recess, two spaced-apart locking projections on a side surface of the auxiliary housing and defining a groove therebetween, the locking surfaces being engageable with rear surfaces of the locking projections to prevent the auxiliary housing from coming out, the disengaging projection being in the groove, whereby a jig can be inserted through the unlocking window and into the groove for deflecting the lock out of engagement with the locking projections.

10. The divided connector of claim 9, wherein the disengaging projection is formed with an introducing surface inclined to guide a leading end of the jig into a clearance between the disengaging projection and the side surface of the auxiliary housing.

11. The divided connector of claim 10, wherein a clearance between the disengaging projection and a wall surface of the groove along a widthwise direction of the groove exceeds a clearance between the auxiliary housing and a wall surface of the accommodating recess substantially along the widthwise direction of the groove.

12. The divided connector of claim 11, wherein a clearance is defined along forward and backward directions between the locking surface of the lock and the locking projections.

13. The divided connector of claim 12, wherein a rear surface of the locking projection is undercut to bulge out towards the leading end thereof.

* * * * *